US011446537B2

(12) United States Patent
D'Alesio

(10) Patent No.: US 11,446,537 B2
(45) Date of Patent: Sep. 20, 2022

(54) KETTLEBELL-TYPE DEVICE

(71) Applicant: REAXING S.R.L., Milan (IT)

(72) Inventor: Gionata D'Alesio, Milan (IT)

(73) Assignee: REAXING S.R.L., Milan (IT)

( * ) Notice: Subject to any disclaimer, the term of this patent is extended or adjusted under 35 U.S.C. 154(b) by 81 days.

(21) Appl. No.: 16/966,625

(22) PCT Filed: Feb. 1, 2019

(86) PCT No.: PCT/IB2019/050816
§ 371 (c)(1),
(2) Date: Jul. 31, 2020

(87) PCT Pub. No.: WO2019/150314
PCT Pub. Date: Aug. 8, 2019

(65) Prior Publication Data

US 2021/0031067 A1 Feb. 4, 2021

(30) Foreign Application Priority Data

Feb. 1, 2018 (IT) ..... 102018000002319

(51) Int. Cl.

| | |
|---|---|
| ***A63B 21/072*** | (2006.01) |
| ***A63B 21/00*** | (2006.01) |
| *A63B 21/06* | (2006.01) |
| *A63B 23/035* | (2006.01) |

(52) U.S. Cl.
CPC ..... *A63B 21/072* (2013.01); *A63B 21/4035* (2015.10); *A63B 21/0602* (2013.01); *A63B 23/035* (2013.01)

(58) Field of Classification Search
CPC ..... A63B 21/0602; A63B 21/0603; A63B 21/072; A63B 21/4035; A63B 23/035
See application file for complete search history.

(56) References Cited

U.S. PATENT DOCUMENTS 8,888,665 B2 11/2014 Pfitzer
8,911,334 B1 * 12/2014 Cotter ..... A63B 21/0602 482/111

(Continued)

FOREIGN PATENT DOCUMENTS

CN 204233667 4/2015
CN 205019632 2/2016

(Continued)

OTHER PUBLICATIONS

International Search Report for PCT/IB2019/050816 dated Jun. 3, 2019, 3 pages.

(Continued)

*Primary Examiner* — Joshua Lee
(74) *Attorney, Agent, or Firm* — Nixon & Vanderhye

(57) ABSTRACT

Disclosed is a kettlebell type apparatus for gymnastics including: a substantially spherical shaped body formed by a single flexible layer made of polymer material which defines an inner cavity: and a rigid handle fixed to the upper part of the body. The cavity is filled with a filling material that includes at least one liquid, where the filling material occupies from 10% to 80% of the volume of the cavity, and in which the body includes at least one sealable mouth for introducing the filling material into the cavity.

16 Claims, 3 Drawing Sheets

(56) References Cited

U.S. PATENT DOCUMENTS

| | | | | |
|---|---|---|---|---|
| 8,979,719 | B2 * | 3/2015 | Januszek | A63B 21/072 482/108 |
| 9,623,274 | B2 * | 4/2017 | Holt, IV | A63B 21/075 |
| 10,532,241 | B2 * | 1/2020 | Boatner | A63B 21/0724 |
| 2009/0093348 | A1 | 4/2009 | Wang | |
| 2010/0248910 | A1 * | 9/2010 | DiLuglio | A63B 21/072 482/93 |
| 2010/0255960 | A1 * | 10/2010 | Kessler | A63B 21/072 482/93 |
| 2011/0275494 | A1 * | 11/2011 | Radi | A63B 21/072 482/93 |
| 2013/0040789 | A1 * | 2/2013 | Kessler | A63B 21/072 482/108 |
| 2013/0337980 | A1 * | 12/2013 | Himmelrick | A63B 21/072 482/108 |
| 2014/0249002 | A1 * | 9/2014 | Fischer | A63B 21/0602 482/106 |
| 2015/0182777 | A1 * | 7/2015 | Rarity, IV | A63B 21/075 482/93 |
| 2017/0001060 | A1 * | 1/2017 | D'Alesio | A63B 21/0602 |

FOREIGN PATENT DOCUMENTS

| | | |
|---|---|---|
| EP | 3 006 093 | 4/2016 |
| KR | 10-2016-0040776 | 4/2016 |
| KR | 10-1628718 | 6/2016 |
| WO | 2013/149294 | 10/2013 |

OTHER PUBLICATIONS

Written Opinion of the ISA for PCT/IB2019/050816 dated Jun. 3, 2019, 7 pages.

* cited by examiner

KETTLEBELL-TYPE DEVICE

BACKGROUND OF THE INVENTION

Field of the Invention

The present invention relates to an apparatus for gymnastics and in particular to an apparatus in the kettlebell family. In detail the invention concerns a kettlebell in which a prevalent amount of the mass is formed by a filling material in liquid form or in granular or powder form that fills a cavity of the apparatus.

Description of the Related Art

In general, a kettlebell is a piece of heavy apparatus that looks like a cannon ball with a gripping handle. It is believed that the kettlebell originated in Russia around the beginning of the 18th century. The Russian word for kettlebell is pronounced "giri" and the men who lifted these weights were known as "girevik". Originally, kettlebells were made of cast iron and the majority of them are still currently produced in this way.

The particularity of a kettlebell with respect to a traditional dumbbell is that its centre of mass extends beyond the hand. This allows swinging movements that are not possible with traditional dumbbells.

As several muscle groups are involved during the swinging movements of a kettlebell, with respect to the lifting of dumbbells, training with the aforesaid apparatus is considered more effective and capable of bringing about better results in less time. In fact, as the centre of mass of a kettlebell also carries out a swinging movement, the action of a much larger number of micro-muscles is required to balance this apparatus compared with a traditional dumbbell, with same conditions.

In the majority of these known apparatus, whether made entirely of metal or of other materials, such as plastics, the position of the centre of mass of the apparatus is fixed.

Therefore, during the performance of an exercise, any variation of position or speed of a part of the body, just as the force exerted by given muscles, is known or in any case predictable by the person carrying out the exercise.

In some training contexts, both at competitive and non-competitive level, or for rehabilitation, it is advantageous to be able to use apparatus or equipment that, either directly or indirectly, exert a variable or unstable load on the body of the athlete or patient.

In fact, it is known that training in which the body is subject to external stimuli (so-called motor interferences) not completely predictable or entirely unpredictable for the person performing an exercise, allows the reaction capacity of the muscles to be developed and increased to a much greater extent with respect to traditional training.

Traditional kettlebells, especially those formed of a monolithic metal body, can also be dangerous if handled without due care or by those without particular expertise. In fact, given the weight of these objects, at times even in excess of 10 kg, and the rapid and wide movements imparted thereto during the performance of the exercises, if the person using the apparatus were to lose their grip it could cause serious damage to objects or people in the vicinity, including the user.

Kettlebells with a metal body coated with a layer of softer material such as rubber or the like are also available on the market. These measures prevent damages, such as scratches or marks, to the surfaces on which the apparatus is placed and reduce the noise caused by contact with these surfaces. However, in the event of impact, even not violent, with people or objects, the apparatus can still be dangerous.

SUMMARY OF THE INVENTION

In this context, the object of the present invention is to provide a kettlebell type apparatus that solves the aforesaid problems of the prior art.

In particular, an object of the present invention is to provide a kettlebell that allows a person to carry out physical exercises disturbed by stimuli, or forces, that cannot be predicted in advance.

In particular, an object of the present invention is to provide an apparatus that, during use, can interfere at least partially with the balance of a person performing an exercise to simulate a reaction.

Another object of the present invention is to provide a kettlebell type apparatus that is safer with respect to known apparatus, both for the person using it and for those in the vicinity.

A further object of the present invention is to provide a kettlebell type apparatus that can be handled comfortably, precisely and safely.

These and other objects are achieved with a kettlebell type apparatus for gymnastics comprising a substantially spherical body that defines an inner cavity, adapted to receive and contain at least one filling material in liquid form, and a rigid handle fixed to the upper part of the body.

The apparatus according to the invention is conceived to be only partly filled with said filling material. The volume of the inner cavity occupied by the filling material is generally comprised between 10% and 80% and more preferably between 30% and 80%. In this way, a part of the volume of the cavity is occupied by air or another gas.

During the performance of an exercise, in which the kettlebell is moved by the person, the filling material can thus move continuously inside the cavity, with different speeds and accelerations as a function of the movements carried out by the athlete.

The movement of the filling material thus generates a continuous variation of the centre of mass of the apparatus, not predictable by the person.

To this end, the use of a liquid is preferable with respect to a solid material in granular or powder form, such as sand or other materials in particles of small size, although these are not excluded.

According to an aspect of the invention, the body is formed by a single flexible layer made of a polymer material. Preferably the body is in one piece.

More in detail, the body of the apparatus is flexible, i.e., not completely rigid, but has a structure such as to maintain its shape, substantially spherical, with or without the filling material inside, during use. However, if the body is subject to impacts, compression or other stresses on the outer surface thereof, it is able to sustain slight elastic deformations.

In this way, as the apparatus is generally moved very quickly with wide movements, it is less dangerous with respect to known apparatus, which are made of metal or in any case completely rigid, if it were to accidentally hit another person or a part of the body of the person holding it. This is particularly useful, for example, when the apparatus is used to train groups, where several people train relatively close to one another in a limited space.

Moreover, as these apparatuses are often released onto the ground at the end of the exercise, this flexible body reduces both the noise emitted in this situation and the risk of it damaging the floor on which it is placed.

According to the invention, the handle of the apparatus is instead rigid. The handle is therefore designed not to deform during use of the apparatus, or in any case to sustain limited deformations, imperceptible to the person performing the exercise.

This, together with the limited deformability of the body, makes it possible to guarantee a manoeuvrability of the apparatus and a precision of movement comparable to those of traditional apparatus, for example made of metal.

Moreover, the single-layer structure of the body allows the production costs of the apparatus to be reduced. For example, the body can be produced in a single step, by means of moulding or similar processes, reducing assembly times to a minimum. Moreover, as this body is substantially monobloc, even if it is subjected to continuous stresses or impacts, it is less liable to break with respect to prior art apparatus made of several parts joined together.

According to the invention, the handle can comprise a gripping portion, which can be grasped with one or with both hands, and at least a coupling portion by means of which it is fixed to the body. To this end, the body is provided with at least one seat adapted to receive said coupling portion.

According to an aspect of the invention, the seat comprises a tubular element, which extends from the upper part of the body, in which a length of the coupling portion is received.

Said tubular element is in fluid communication with the inner cavity of the body. This element acts as a mouth for introducing the filling material during manufacture of the apparatus.

In fact, according to an aspect of the invention, the apparatus is provided sealed with a specific amount of filling material inside. Therefore, the apparatus has a predefined weight as a function of the amount of filling material introduced into it by the manufacturer.

The aforesaid mouth, once the filling material has been introduced, is closed and sealed by the coupling portion of the handle. Preferably, coupling between the coupling portion and the tubular element has a slight interference to guarantee both the mechanical and the hydraulic tightness between the two parts. Considering the stresses to which the apparatus is subjected, the aforesaid parts are in any case preferably joined by sealing adhesives, such as silicone or the like, also in order to guarantee perfect water-tightness of the cavity.

The coupling portion of the handle, a length of which extends inside the tubular element, helps to stiffen the part of the apparatus subjected to the most stress during use, helping to improve the precision of the movements.

According to an aspect of the invention, the thickness of the layer of the body is a function of the material used and is calibrated to obtain the characteristics of stability of shape described above. Typically, the thickness of the layer of the casing is comprised between 2 mm and 10 mm, preferably between 3 mm and 7 mm, even more preferably between 3 and 6 mm.

The material of said layer is impermeable to liquids to be able to retain the liquid filling material inside the cavity. According to a preferred variant, the body is made of synthetic rubber. Alternatively, other polymeric materials having similar mechanical properties, or natural rubber, can be used.

Alternatively, the body can be made of other polymeric materials such as polyvinyl chloride, polyethylene, polyethylene terephthalate, polypropylene or polyurethane.

According to a preferred variant, the material of the body is transparent or partially transparent, so that the filling material inside it can be seen.

Optionally, the body can be flattened in the lower part so as to define a stable base.

According to another variant, the body can comprise several parts joined to one another by means of welding or heat sealing, or equivalent techniques.

According to an aspect of the invention, the handle can be made of metal or, preferably, of a plastic material. Preferable materials are thermoplastic polymers such as polyethylene (PE), polyvinyl chloride (PVC) or polypropylene (PP), or thermosetting polymers.

Typically, the handle is made of a solid monobloc element, so as to provide sufficient rigidity also in the case of the use of plastic materials.

According to a preferred variant of the invention, the handle is substantially U-shaped. According to this variant, the gripping portion comprises a substantially rectilinear bar extending from the ends of which are two coupling portions arranged transversely or substantially perpendicularly to the gripping portion. The body is in turn provided with two respective tubular seats adapted to house the two coupling portions.

According to an aspect of the invention, the coupling portion comprises a pin, delimited by an abutment edge, adapted to be housed in the seat of the body. Said pin generally has a smaller section than the remaining part of the coupling portion.

The abutment element allows the handle to be fixed with precision to the body and the water-tightness of the cavity to be increased.

According to an aspect of the invention, the liquid of the filling material consists of water, optionally mixed with additives to limit evaporation.

According to a preferred variant, in addition to the liquid, the filling material can also comprise solid particles with a higher specific weight than water, such as sand or metal balls. Said particles, due to their different specific weight, move in the cavity separately from the liquid, generating a different inertia on the apparatus. These particles also allow the overall weight of the apparatus to be increased with the same dimensions, i.e. volume of the inner cavity.

Where the body is at least partially transparent, the liquid can be mixed with dyes or made opaque, to make it more visible inside the cavity. Different colours can be adopted to indicate different weight values of different apparatus.

According to a possible variant, the body can be provided with a valve for introducing or removing air, or another gas, into or from the cavity. In this way it is possible to increase or decrease the internal pressure to vary the rigidity of the body.

BRIEF DESCRIPTION OF THE DRAWINGS

Further features and details of the invention will be better understood from the description below, provided by way of non-limiting example, and from the accompanying drawings, wherein.

DESCRIPTION OF THE PREFERRED EMBODIMENTS

Figure 1:
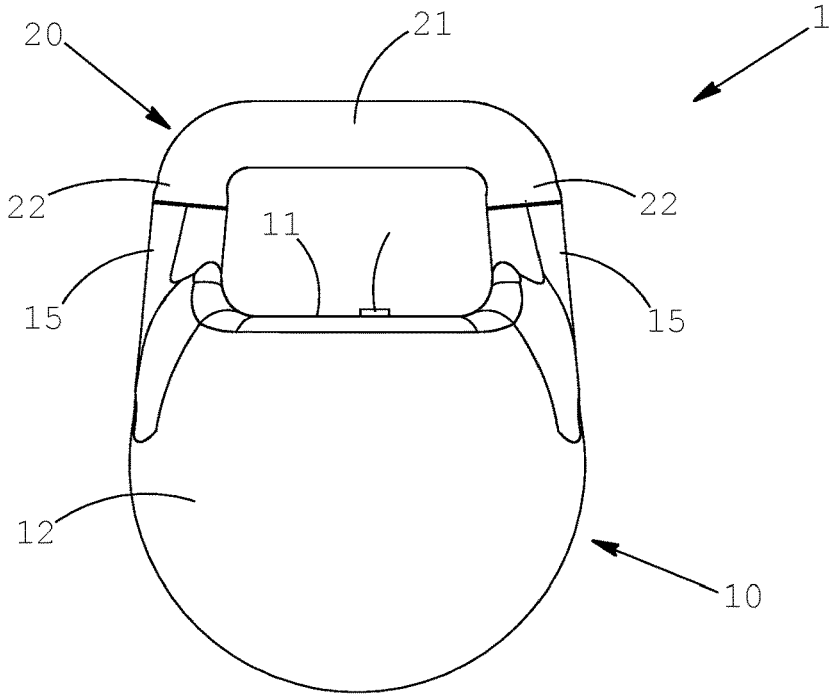
FIG. 1 is a front view of the kettlebell type apparatus for gymnastics according to the invention.
Figure 2:
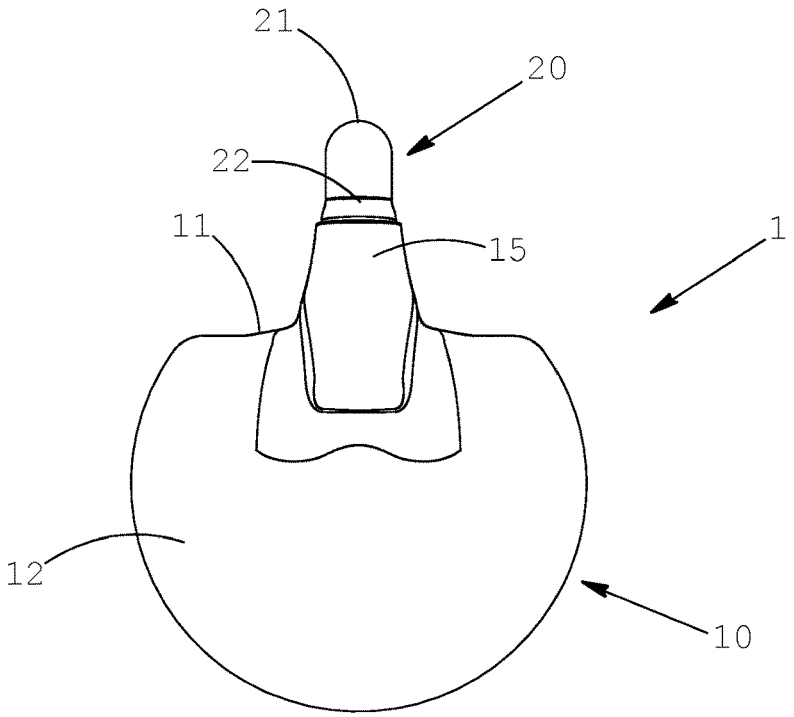
FIG. 2 is a side view of the apparatus of FIG. 1.

With reference to the accompanying figures, the numeral 1 indicates as a whole the kettlebell type apparatus for gymnastics. The apparatus comprises a body 10 and a handle 20 fixed to said body in the upper part. The body 10 is preferably spherical or substantially spherical. In the example of the figures the body 10, in the upper part, has a flattened area 11 to leave more space for the movement of the hand, or hands, when the apparatus is rotated or swung during the performance of an exercise.

Optionally, the lower part of the body 10 can also be flattened so as to define a stable base.

The body 10 comprises a hollow casing 12 that defines an inner cavity 13. Said cavity 13 is partially filled with a liquid L and optionally with solid particles such as sand or metal particles. Alternatively, the cavity 13 can be filled only with a solid filling material in granular or powder form, such as one of those mentioned above.

The cavity is occupied by the filling material, for a percentage of its volume preferably comprised between 30% and 80% and more preferably between 40% and 60%.

According to the invention, the cavity 13 is filled with a predefined amount of liquid L, and optionally with solid particles, and is sealed so that the weight of the apparatus is specific and stable.

The body 10 is preferably made of synthetic rubber, and is produced by means of moulding or equivalent technologies. The thickness of the casing 12 of the body 10 is comprised between 3 mm and 6 mm and, preferably, is of around 5 mm. The body thus produced is slightly flexible or yielding, so as to absorb any impacts with people or objects, during its use, but at the same time capable of substantially maintaining its shape, i.e. of not collapsing or becoming excessively deformed during use.

Two seats 14 for fixing the handle 20 are produced in the flattened area 1 of the upper part of the body 10. Said seats 14 comprise respective tubular elements 15 which extend upwards along respective directions substantially parallel or slightly divergent or convergent. Said tubular elements 15 are preferably joined with the casing of the body 10 and are produced in one part therewith.

Preferably, at least one or both said tubular elements 15 are in connection with the cavity 13 and can be used as a mouth for introducing the filling material into the cavity 13.

The handle 20 comprises a gripping portion 21, which can be grasped with one or with both hands, and two coupling portions 22 that extend transversely from the ends of the gripping portion 21. In the example in the figure, said coupling portions are slightly divergent but, at the same time, could be parallel or convergent.

Figure 3:
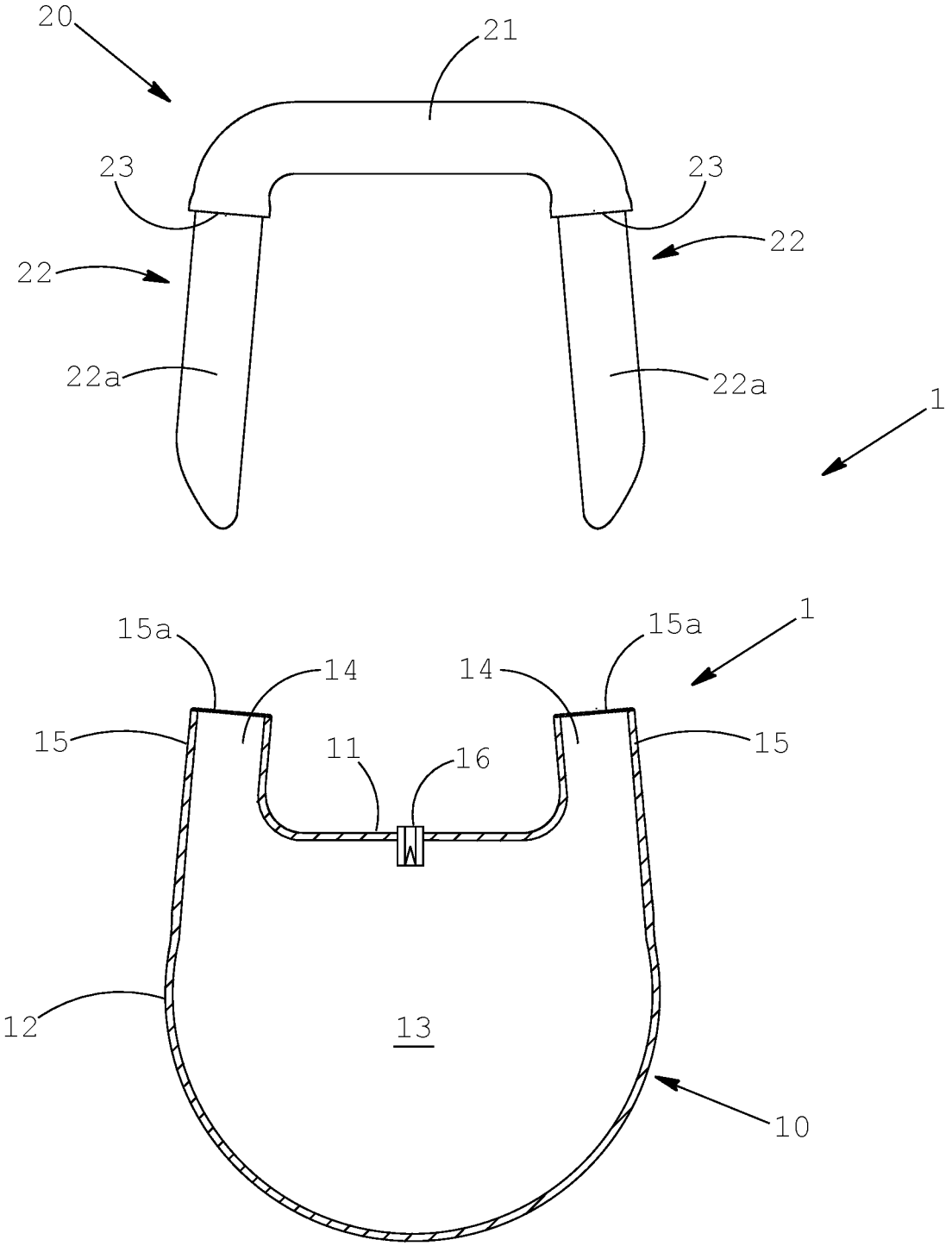
FIG. 3 is a sectional view of the apparatus with the body and the handle separated.
Figure 4:
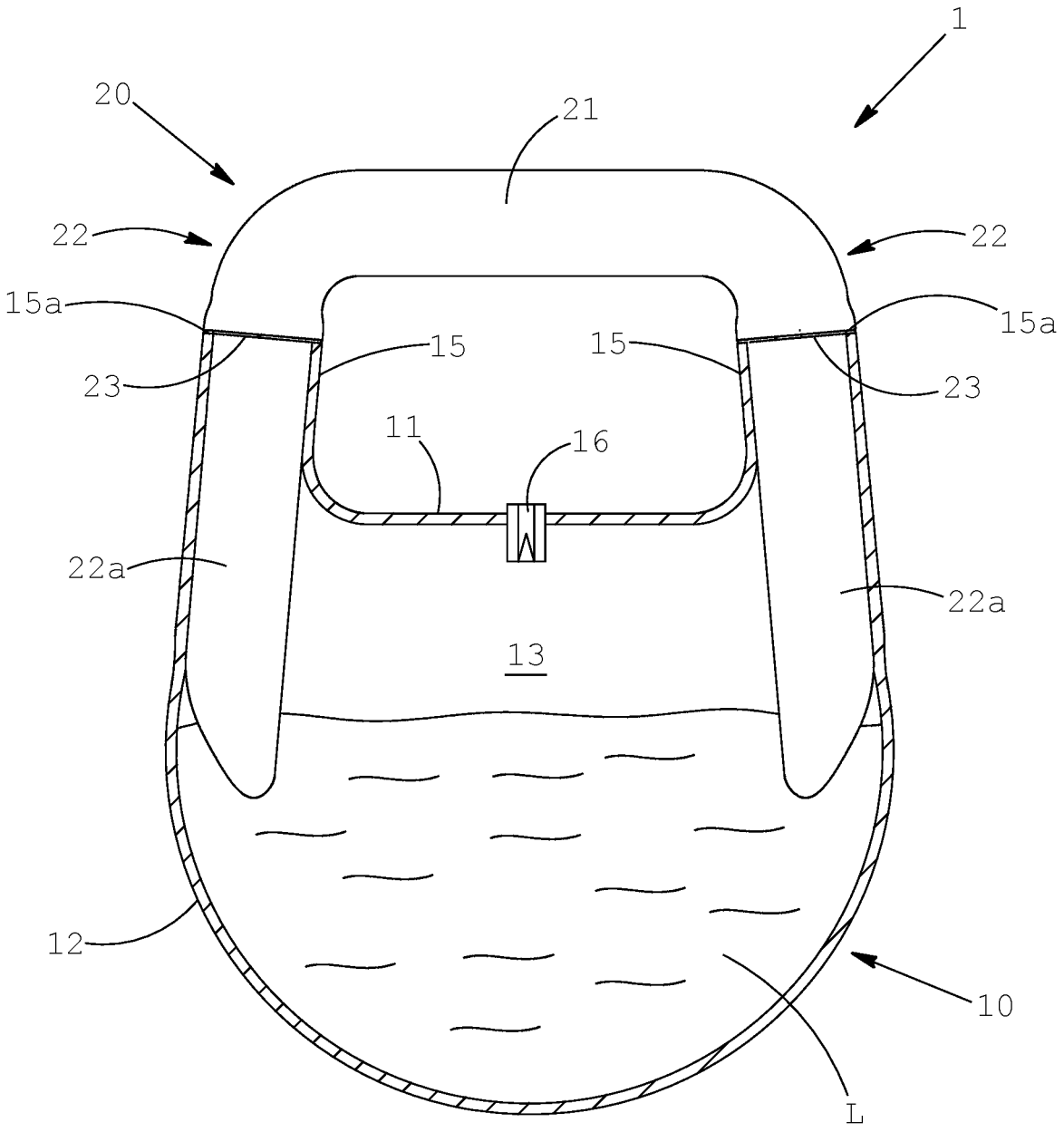
FIG. 4 is a sectional view of the apparatus of FIG. 1.

As can be seen in FIG. 3, the handle therefore has a substantially upside down U-shape in which the coupling portions 22 are joined to the gripping portion 21.

Each coupling portion 22 comprises a pin 22*a* delimited by an abutment edge 23. This pin 22*a* is the part of the coupling portion that is inserted completely into the tubular element 15. In this way, the abutment edge 23 is resting against the upper edge 15*a* of the tubular element 15.

At least an inner length of the tubular element 15 and the pin 22*a* of the coupling portion 22, are preferably substantially cylindrical in shape. The inner diameter of the tubular element 15 in that section is slightly smaller than the diameter of the section 22*a* so that said elements are coupled with a certain interference that guarantees both stable fixing and a certain hydraulic tightness.

Preferably, especially if there is a liquid inside the cavity, this fixing is aided by sealants, such as silicone or the like, to guarantee the water-tightness of the cavity 13.

The handle is sized so as not to bend during use of the apparatus so as to guarantee a high level of sensitivity and precision of movement.

According to a preferred variant, the handle is made of a plastic material, for example a thermoplastic polymer, such as polyvinyl chloride or polyethylene.

The length of the pins 22*a* of the coupling portions 22 is preferably greater with respect to the length of the tubular elements 15. Said pins 22*a* therefore extend inside the cavity and remain, for at least a section, against the inner wall of the casing 12 increasing the rigidity of the connection between body 10 and the handle 20.

According to a possible variant, the body 10 can be provided with a valve 16 for introducing or removing air into or from the cavity 13. The valve 16 can be positioned in the upper part of the body, for example in the flattened part 11, or in any other point of the casing 12. The introduction or removal of air through the valve allows the inner pressure to be varied and therefore make the casing 12 more or less taut and, therefore, more or less rigid.

The invention claimed is:

1. A kettlebell apparatus for gymnastics, the kettlebell apparatus comprising:

a substantially spherical-shaped body defining an inner cavity that is filled with a filling material that comprises at least one liquid, the body comprising at least one sealable mouth configured to introduce said filling material into said cavity, the body being formed by a single flexible layer made of polymer material configured to maintain a substantially spherical shape of the body with or without the filling material in the cavity, during use, so that the body is configured to sustain elastic deformations when subject to impact, compression, or stress on an outer surface thereof, during use; and a rigid handle fixed to an upper part of the body.

2. The apparatus according to claim 1, wherein the body is made of a synthetic rubber.

3. The apparatus according to claim 2, wherein the thickness of the layer of the body is between 3 mm and 7 mm.

4. The apparatus according to claim 2, wherein the handle is made of a material chosen from one of a metal, a thermoplastic polymer, and a thermosetting polymer.

5. The apparatus according to claim 1, wherein the thickness of the layer of the body is comprised between 3 mm and 7 mm.

6. The apparatus according to claim 5, wherein the handle is made of a material chosen from one of a metal, a thermoplastic polymer, and a thermosetting polymer.

7. The apparatus according to claim 1, wherein the handle is made of a material chosen from one of a metal, a thermoplastic polymer, and a thermosetting polymer.

8. The apparatus according to claim 1, wherein the handle comprises a gripping portion and at least a coupling portion that extends from the gripping portion, the body comprising a seat configured to receive said coupling portion.

9. The apparatus according to claim 8, wherein said seat comprises a tubular element, which extends from the upper part of the body, configured to receive at least a length of the coupling portion.

10. The apparatus according to claim 9, wherein said tubular element is in fluid communication with the cavity and acts as the sealable mouth to introduce the filling material into the cavity, said sealable mouth being sealed after filling of the cavity.

11. The apparatus according to claim 8, wherein the handle is substantially U-shaped, and wherein the gripping portion comprises a substantially rectilinear bar extending transversely from the ends of which are two coupling portions housed in respective seats in the body.

12. The apparatus according to claim 9, wherein the coupling portion comprises a pin inserted into the tubular element, said pin being delimited by an abutment edge.

13. The apparatus according to claim 1, wherein the filling material comprises solid particles dispersed in the liquid.

14. The apparatus according to claim 1, wherein the material of the body is at least partially transparent, and wherein the liquid of the filling material is colored or opaque.

15. The apparatus according to claim 1, wherein the body is configured to be provided with a valve for introduction or removal of air into and from the cavity.

16. The apparatus according to claim 1, wherein said filling material occupies from 10% to 80% of the volume of the cavity.

* * * * *